US006705114B2

(12) United States Patent
Steiner

(10) Patent No.: US 6,705,114 B2
(45) Date of Patent: Mar. 16, 2004

(54) DECORATIVE STONE MADE OF GLASS

(75) Inventor: Klaus Steiner, Mils (AT)

(73) Assignee: D. Swarovski & Co., Wattens (AT)

( * ) Notice: Subject to any disclaimer, the term of this patent is extended or adjusted under 35 U.S.C. 154(b) by 0 days.

(21) Appl. No.: 10/156,071

(22) Filed: May 29, 2002

(65) Prior Publication Data

US 2003/0221451 A1 Dec. 4, 2003

(51) Int. Cl.[7] ..... A44C 17/00

(52) U.S. Cl. ..... 63/32; 63/34; 63/14.9; D11/89; D11/90

(58) Field of Search ..... 63/32, 34, 14.9; D11/89, 90; 125/30.01

(56) References Cited

U.S. PATENT DOCUMENTS

| | | | | | |
|---|---|---|---|---|---|
| 1,377,130 | A | * | 5/1921 | Hashimoto | 63/32 |
| 2,270,270 | A | * | 1/1942 | Clare | 63/32 |
| 2,569,398 | A | * | 9/1951 | Burd et al. | 428/78 |
| 2,596,965 | A | * | 5/1952 | Troy | 2/239 |
| 2,907,187 | A | * | 10/1959 | Karp et al. | 63/28 |
| D270,434 | S | * | 9/1983 | Sun | D11/129 |
| 4,604,876 | A | * | 8/1986 | Hoffmann | 63/32 |
| D442,881 | S | * | 5/2001 | Kavalek | D11/90 |
| D461,141 | S | * | 8/2002 | Steiner | D11/90 |

FOREIGN PATENT DOCUMENTS

| | | |
|---|---|---|
| CH | 369928 | 7/1963 |
| DE | 2 014 966 | 3/1972 |

OTHER PUBLICATIONS tattoofun.com website printout of Body Crystals, 3 pages. May 2003.* shop.store.yahoo.com/glamgirls printout of information about Glam Girls Crystal Body Art, 2 pages. May 2003.* getglam.com printout of Crystal Body Art, 2 pages. May 2003.* ronsrhinestones.com printout of rhinestone body tattoos, 2 pages. May 2003.* lovenlightgems.com printout of Crystal Body Gems, 5 pages. May 2003.*

* cited by examiner

*Primary Examiner*—Anthony Knight
*Assistant Examiner*—Andrea Chop
(74) *Attorney, Agent, or Firm*—Wenderoth, Lind & Ponack, L.L.P.

(57) ABSTRACT

A decorative stone made of glass is provided with a facetted front and a mirrored rear converging from the periphery of the stone to a point provided with an adhesive (10), wherein the angle between opposite surfaces of the rear of the stone (1) is more than 150°.

18 Claims, 1 Drawing Sheet

DECORATIVE STONE MADE OF GLASS

BACKGROUND OF THE INVENTION

1. Field of the Invention

The invention relates to a decorative stone made from glass with a facetted front, and a mirrored rear converging from the periphery of the stone to a point provided with an adhesive.

2. Description of Related Art

It has long been known (see GB 1 325 293) to provide glass decorative stones with an adhesive on the rear, so that they can be ironed individually or in the form of a pattern applied to transfer foils onto a textile substrate. In areas of application where ironing is inadvisable, for imitation tattoos in particular, a pressure-sensitive adhesive is used instead of the usual hot-melt adhesive.

Decorative stones coated with adhesives basically have a planar rear, and the corresponding stone shape is known commercially as a rose. In exceptional cases, stones with a concave rear have even been proposed in order to improve adhesion (see WO 97/41746 and DE 26 46 727).

There is a need to configure stones of the type described in the Background such that they can be attached to a substrate using an adhesive. In particular, this is the case when the stones have a planar central area (table) on the front and their type of cut ("chaton") thus resembles a diamond.

In the case of diamonds, a chaton normally has an angle between 96° and 98° at the point of the stone. In spite of the substantially different refractive index, with a glass stone, an optical behavior comparable to diamonds of a similar size is obtained. This is possible because the total reflection occurring on the rear of diamonds is replaced by mirroring. The term mirroring, as used herein, means treating a surface of an object, such as with silvering, to create a more reflective surface.

Chatons with a standard angle have already been used occasionally on textile substrates, but these are limited to very small stones with a diameter of less than 2.5 mm, and particularly soft substrates, because the gap between the periphery of the stone and substrate is otherwise too large.

If required, a certain increase in the diameter of adhesive chatons would be obtainable if the flattest of the chatons previously proposed were to be used, as have been described with an angle of 130°, and claimed for with an angle of up to 150° in AT 393 597. Larger stones have actually been used, however, configured with a flat rear, that is to say in rose form. In contrast to rivoli stones, when stones are chaton-cut, that is to say with a front table, this results in a central part that gives a less lively impression. Stones with a substantially increased brilliance are unexpectedly produced when the rear angle is made large enough for the adhesion of the stones no longer to be obstructed by the corresponding slight unevenness of the rear side of the stone.

SUMMARY OF THE INVENTION

The decorative stone made of glass of the present invention has a facetted front and a mirrored facetted rear converging from the periphery of the stone to a point, and the rear of the stone is provided with an adhesive. The decorative stone is provided with an angle of more than 150° between opposing surfaces of the rear of the stone.

In another aspect of the present invention, the decorative stone is provided with an angle of more than 160° between the two opposing surfaces of the rear of the stone.

In yet another aspect of the present invention, the decorative stone is provided with an angle between 170° and 175° between the two opposing surfaces of the rear of the stone.

Further, the front of the decorative stone of the present invention is provided in the central area of the stone with a planar surface, and the rear of the adhesive coated stone is planar.

Further details of the invention will be explained with reference to the drawings.

DETAILED DESCRIPTION OF THE PREFERRED EMBODIMENTS

Figure 1:
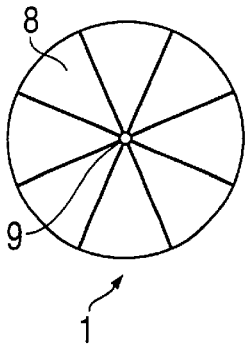
FIG. 1 (PRIOR ART)
FIGS. 1 to 3 illustrate the flattest chaton described until now from the rear, side and front views, respectively.
Figure 2:
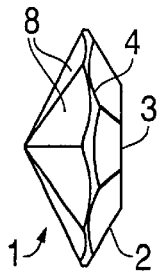
FIG. 2 (PRIOR ART)
Figure 3:
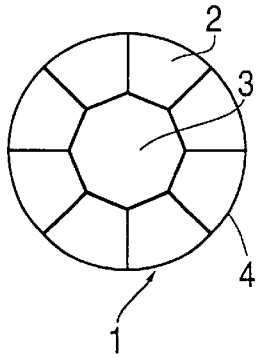
FIG. 3 (PRIOR ART)

The known stone 1 as shown in FIGS. 1–3 is made of glass, preferably of glass with a high refractive index. As is usual in the case of stones that are sold commercially under the description of chatons, eight planar surfaces 8 come together to a point, from the circular girdle 4, which can be somewhat flattened into a culet 9. From the girdle 4, eight planar surfaces 2 extend forwards, terminating in the planar table 3 configured as a regular octagon.

What is unusual about the stone 1 shown in FIGS. 1–3 is 130° the angle between opposing surfaces 8 of the rear of the stone. Such an angle results in a completely different optical path for the incident light than is sought in conventional diamond cutting. It has been proved, however, that when the stone shown is used for manufacturing cup chains, the type of refraction of the light normally incident upon the table 3 is not vitally important. In contrast to an individual decorative stone that is worn perhaps as a pendant or ring, there are no preferred orientations for the mutual relationship of light source, stone and observer with a cup chain. This results in the individual stones always being in a position in which light already dispersed is reflected towards the observer.

With the stones according to the present invention, however, which are designed for adhesion onto a substrate, it has to be assumed that the direction of observation is normal to the stones. The observer of a stone with a front table and planar rear (rose with chaton cut) thus sees less dispersed light, as, with a large diameter, the stone has relatively little brilliance. The present invention provides facetting of the mirrored rear of the stone with an extremely large angle and thus an extremely low point on the rear of the stone, which is unexpectedly sufficient for substantially enlivening the stone. By means of this low point, it is possible to make the delimitation surface of the glue completely, or almost completely flat, and thus make the adhesive invisible along the periphery of the stone. If a thickness of the adhesive is 0.3 mm in the proximity of the periphery of the stone, the rear of the glue is completely planar. With a stone with a 2 mm diameter, an angular field of approximately 150° and a peripheral angle of the facets of approximately 15° is provided. Further, with a stone diameter of 7 mm, an angular field of approximately 170° with a peripheral angle of approximately 5° is provided.

Accordingly, due to the above-described angular fields and peripheral angles, the angle between opposing surfaces of the rear of the stone are provided to be an angle of more than 150° and up to 175°. In the embodiment according to FIGS. 4 to 6, the stone has only one set of mirrored facets 8 on the rear that are inclined at an angle of approximately 5° to the central plane of the stone. These facets are covered with an adhesive 10, the thickness of which decreases towards the center, so that the rear of the coated stone is completely planar and the peak, the low point extending outward from the rear of the stone to which the facetted surfaces of the rear of the stone converge outwardly to, does not protrude the adhesive layer. As the angle of inclination of the facets 8 is so slight, it would also be possible to use an adhesive 10 of constant thickness (for example, of 0.3 mm).

Figure 4:
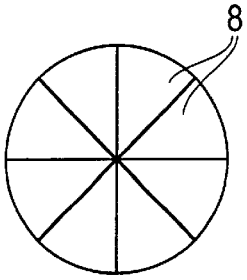
FIGS. 4 to 6 illustrate a first embodiment of a stone according to the present invention from the rear, side and front views, respectively.
Figure 5:
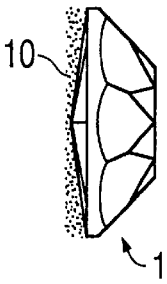
Figure 6:
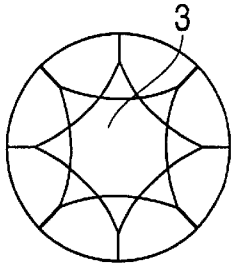
Figure 7:
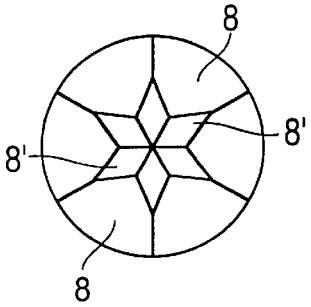
FIGS. 7 to 9 illustrate a second embodiment represented in a manner similar to FIGS. 1 to 3.
Figure 8:
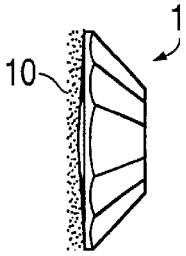
Figure 9:
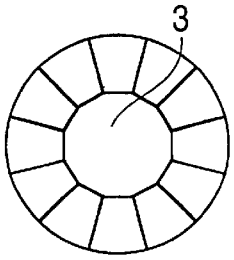

The embodiment according to FIGS. 7 to 9 differs from the embodiment according to FIGS. 4–6 in that second set of facets 8' is provided that are opposite the facets 8. The large number of the surfaces (8 and 8') largely compensates for a disadvantage caused by the slight inclination of the different facetted surfaces. The angle between opposing surfaces 8 and 8' of the rear of the stone is more than 150° and may also be more than 160°. Further, with a stone diameter of 7 mm and an angular field of approximately 170° with a peripheral angle of approximately 5°, the angle between opposing surfaces 8 and 8' of the rear of the stone may be between 170° and 175°.

What is claimed is:

1. A decorative glass stone comprising:

a facetted front portion;

a rear portion including a plurality of mirrored surfaces extending from a periphery of said stone in a direction away from said facetted front portion, wherein said mirrored surfaces converge at a point, and opposing surfaces of said mirrored surfaces form an angle that is greater than 150 degrees; and an adhesive provided on said rear portion.

2. The decorative stone according to claim 1, wherein said opposing surfaces form an angle greater than 160 degrees.

3. The decorative stone according to claim 2, wherein said opposing surfaces form an angle between 170 and 175 degrees.

4. The decorative stone according to claim 1, wherein said rear portion of said stone is provided with two sets of planar surfaces.

5. The decorative stone according to claim 1, wherein said front portion comprises a planar surface in a central area of said front portion.

6. The decorative stone according to claim 1, wherein a diameter of said stone is between approximately 2 millimeters and 7 millimeters.

7. The decorative stone according to claim 1, wherein said adhesive layer provided on said rear portion forms a substantially planar surface.

8. The decorative stone according to claim 7, wherein said point at which said mirrored surfaces of said rear portion converge is entirely covered by said adhesive.

9. The decorative stone according to claim 1, wherein said stone is a single glass piece.

10. A decorative glass stone comprising:

a facetted front portion; and a rear portion including a plurality of mirrored surfaces extending from a periphery of said stone in a direction away from said facetted front portion and converging at a point, said mirrored surfaces being arranged so that opposing surfaces of said mirrored surfaces form an angle that is greater than 150 degrees, wherein said rear portion is adapted to receive an adhesive for adhering said stone to a substrate.

11. The decorative stone according to claim 10, wherein said opposing surfaces form an angle greater than 160 degrees.

12. The decorative stone according to claim 11, wherein said opposing surfaces form an angle between 170 and 175 degrees.

13. The decorative stone according to claim 10, wherein said rear portion of sad stone is provided with two sets of planar surfaces.

14. The decorative stone according to claim 10, wherein said front portion comprises a planar surface in a central area of said front portion.

15. The decorative stone according to claim 10, wherein a diameter of said stone is between approximately 2 millimeters and 7 millimeters.

16. The decorative stone according to claim 10, further comprising an adhesive provided on said rear portion, wherein an outer surface of said adhesive is substantially planar.

17. The decorative stone according to claim 16, wherein said point at which said mirrored surfaces of said rear portion converge at is entirely covered by the adhesive.

18. The decorative stone according to claim 10, wherein said stone is a single glass piece having said facetted front portion and said rear portion.

* * * * *